United States Patent [19]

Pecheux

[11] Patent Number: 4,905,677

[45] Date of Patent: Mar. 6, 1990

[54] APPARATUS FOR THE MOBILIZATION OF A LOWER LIMB

[75] Inventor: Jean-Claude Pecheux, Tournes Cliron, France

[73] Assignee: Compagnie Generale de Materiel Orthopedique, Tournes Cliron, France

[21] Appl. No.: 819,246

[22] Filed: Jan. 15, 1986

[51] Int. Cl.[4] ..... A01H 1/02

[52] U.S. Cl. ..... 128/25 R

[58] Field of Search ..... 128/25 R, 25 B, 26, 128/80 A, 87 C, 85, 80 G, 80 R, 84, 584, 583, 506, 24 R, 48, 51, 901, 91; 116/303

[56] References Cited

U.S. PATENT DOCUMENTS

| | | | |
|---|---|---|---|
| T100,602 | 5/1981 | Roley et al. | 128/782 |
| 1,879,001 | 9/1932 | Allen . | |
| 1,904,942 | 4/1933 | Heigl . | |
| 2,152,431 | 3/1939 | Jensen . | |
| 2,374,163 | 4/1945 | Burchsted . | |
| 2,413,053 | 12/1946 | Kolarik . | |
| 2,511,659 | 6/1950 | Wilson . | |
| 2,763,261 | 9/1956 | Masmonteil et al. . | |
| 3,060,926 | 10/1962 | May | 128/25 R |
| 3,066,322 | 12/1962 | Derby . | |
| 3,135,257 | 6/1964 | Anderson . | |
| 3,450,132 | 6/1969 | Ragon et al. . | |
| 3,616,795 | 11/1971 | Powlan . | |
| 3,661,150 | 5/1972 | Peterssen et al. . | |
| 3,717,144 | 2/1973 | Bimler | 128/80 A |
| 3,765,411 | 10/1973 | Ward, Jr. . | |
| 3,878,842 | 4/1975 | Goldberg . | |
| 3,976,057 | 8/1976 | Barclay . | |
| 4,089,330 | 5/1978 | Nicolosi . | |
| 4,323,060 | 4/1982 | Pecheux . | |
| 4,509,509 | 4/1985 | Bouvet | 128/25 R X |
| 4,558,692 | 12/1985 | Greiner | 128/25 R |
| 4,577,623 | 3/1986 | Pecheux | 128/25 R |
| 4,602,618 | 12/1984 | Berze | 128/25 R |
| 4,603,687 | 8/1986 | Greenwood | 128/25 R |
| 4,628,909 | 12/1986 | Tietsworth | 128/25 R |
| 4,671,257 | 6/1987 | Kaiser et al. | 128/25 R |

FOREIGN PATENT DOCUMENTS

| | | | |
|---|---|---|---|
| 9485 | of 1904 | United Kingdom . | |
| 112812 | 1/1918 | United Kingdom . | |
| 159422 | 3/1921 | United Kingdom . | |
| 371571 | 4/1932 | United Kingdom . | |
| 1334115 | 1/1971 | United Kingdom . | |
| 191678 | 12/1905 | Fed. Rep. of Germany . | |
| 294286 | 4/1915 | Fed. Rep. of Germany . | |
| 297482 | 8/1915 | Fed. Rep. of Germany . | |
| 522975 | 3/1931 | Fed. Rep. of Germany . | |
| 849167 | 7/1949 | Fed. Rep. of Germany . | |
| 919428 | 10/1954 | Fed. Rep. of Germany . | |
| 2524468 | 9/1976 | Fed. Rep. of Germany . | |
| 1057532 | 3/1954 | France . | |
| 2407710 | 6/1979 | France . | |
| 2439009 | 5/1980 | France . | |
| 2440187 | 5/1980 | France . | |
| 2468360 | 5/1981 | France . | |
| 7712974 | 11/1976 | Netherlands . | |
| 63701 | 1/1913 | Switzerland . | |
| 657816 | 4/1979 | U.S.S.R. . | |
| 740246 | 6/1980 | U.S.S.R. | 128/25 R |

OTHER PUBLICATIONS

Sutter, "Sutter CPM 9000", Sutter Biomedical Inc., Jan. 1985.

Joint Mobilizer Systems, Inc., "Knee-Hip Mobilizer Ankle Mobilizer".

Danninger Medical Technology, Inc.,—"The Kineflex".

Sutter CPM Device.

*Primary Examiner*—Richard J. Apley

*Assistant Examiner*—H. Flaxman

*Attorney, Agent, or Firm*—Pravel, Gambrell, Hewitt, Kimball & Krieger

[57] ABSTRACT

The apparatus for the mobilization of a lower limb according to the invention comprises: a beam mounted for pivoting on the base via an axis of horizontal reference position, a drive member controlling the pivoting movement of the beam between a stable horizontal rest position and a maximum angular opening position, and vice versa, an articulated assembly placed sideways with respect to either one of the sides of the beam, and means for resting and rolling the distal end of the tibial section of the articulated assembly over a base supporting plane.

16 Claims, 6 Drawing Sheets

1
2
3
4
5
6
7
8
9
10
11
12
13
14
15
16
16a
17
18
18a
19
20
21
22
23
24
26
27
28
29
30
42
43
44
44'
B
B'
CC'

APPARATUS FOR THE MOBILIZATION OF A LOWER LIMB

The present invention is concerned with the field of medical equipment and relates to equipments used for orthopaedic treatment or functional reeducation of the lower limbs.

To this end, the proposed equipment is constituted by a splint comprising a femoral cradle connected by an articulation to a tibial cradle, both cradles being equipped with a hammock for receiving the corresponding part of the limb to be supported.

The femoral cradle is articulated on a supporting frame or base, generally equipped with means for guiding the displacement of a supporting member associated to the distal end of the tibial cradle.

A motorizing device is interposed between the base and the articulated assembly formed by the two cradles, in order to control the displacement in maximum extension or in flexion when the traumatized limb has to be mobilized.

These equipments, such as those known for example from French patent 78-29866 (2 439 009) are found on the whole to be satisfactory, because they are simple to use, not only for medical staff, but also for the patient if the latter is called upon to control, by himself, the cycle of operations of the splint in order to control the imposed sequences of mobilization.

This type of equipment requires small spaceroom and can rest directly by its base, on a support plane, such as for example, a mattress or the therapeutic table on which the patient is lying.

Nevertheless, it has been found that these equipments are not the answers to all cases of functional reeducation. It is not, for example, possible with them, to urge the lower limbs to move in flexionextension extension from a total extension of the hip.

This is due to the fact that the articulated assembly, constituted of the femoral section and the tibial section, is superposed on the base. The resulting vertical space requirement thus determines the hip maximum extension position from which a mobilization becomes possible. Between this position and the position of maximum extension or nil flexion of the hip, there remains an angular range for which no mobilization can be imposed to the limb.

It is precisely the object of the present invention to overcome this drawback by recommending a new mobilization apparatus which makes it possible to subject a lower limb to a flexion-extension mobilization from a position of total extension or nil flexion of the hip corresponding to the limb support and rest position on a support plane.

Another object of the invention is to take advantage of the structure recommended hereinabove in order to give an extra possibility of mobilization, never heretofore attained and which is that of concomitant abduction combined with flexion, this in order to contribute, through passive mobilization, to the reeducation of the coxofemoral articulation in abduction adduction movement A further object of the invention is also to take advantage of the structure recommended hereinabove, in order to procure a mobilization of the lower limb in flexion-extension, for a passive reeducation of the knee, with optionally, an active mobilization for reeducating the knee, and for reeducating the muscular power of the quadriceps.

Yet a further object of the invention is to take advantage of the structure recommended hereinabove, in order to enable ready adaptation of the mobilization apparatus, either for a right or a left lower limb, and this, whatever the lengths of the actions composing it.

These objects are reached, according to the invention, with an apparatus comprising :

a beam mounted for pivoting on the base via an axis of horizontal reference position, a drive member controlling the pivoting movement of the beam between a stable horizontal rest position and a maximum angular opening position, and vice versa, an articulated assembly placed sideways with respect to either one of the sides of the beam, and means for resting and rolling the distal end of the tibial section of the articulated assembly over a base supporting plane.

The invention will be more readily understood on reading the following description with reference to the accompanying drawings in which.

Figure 1:
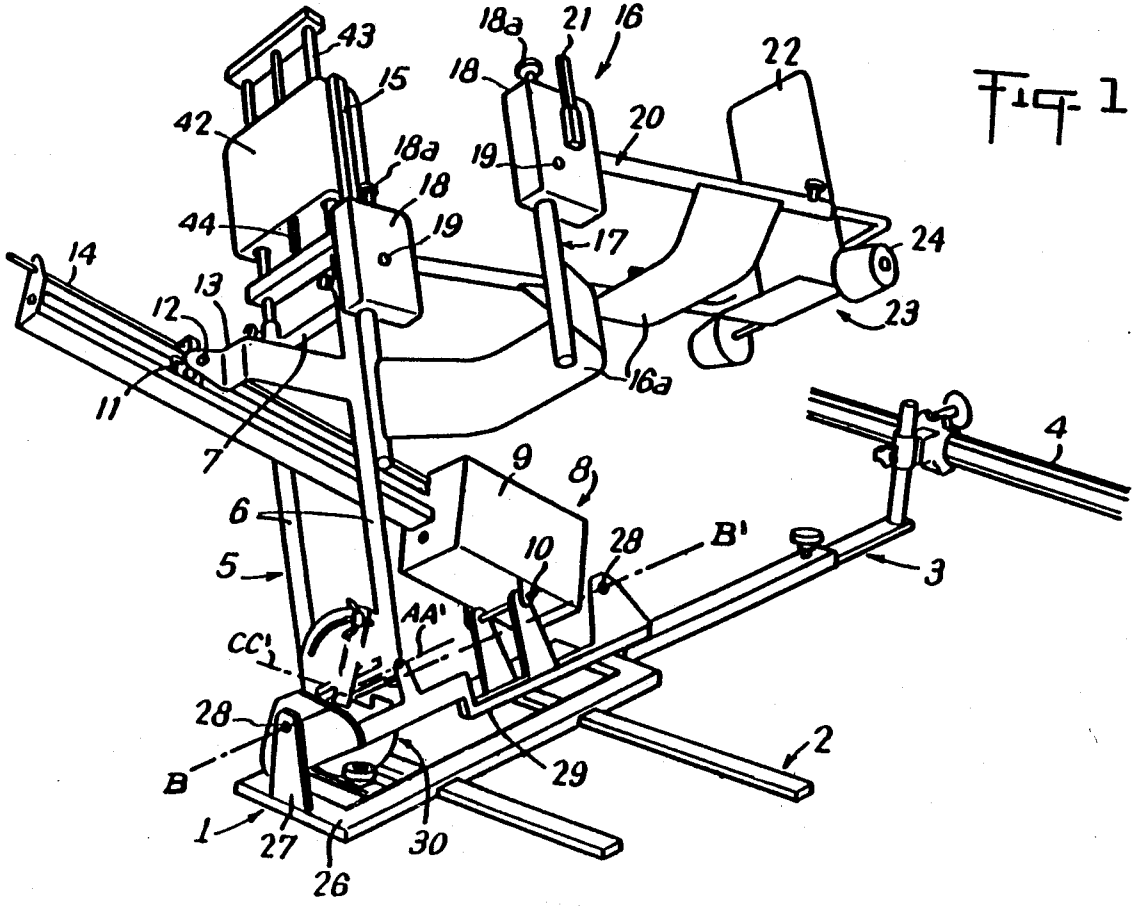
FIG. 1 is a perspective view of the object of the invention.
Figure 2:
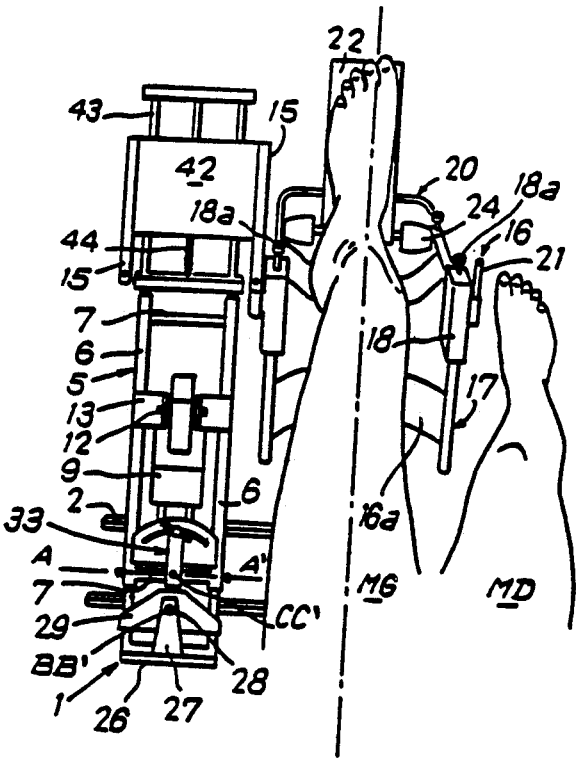
FIG. 2 is a plan view corresponding to FIG. 1.

The apparatus for mobilizing a lower limb, according to the invention, comprises, as illustrated in FIGS. 1 and 2, a base 1 restable on a support plane, such as a table surface or the mattress of a bed. Said base 1 is coupled, to this effect, to stable lateral rest means, such as adjustable cross-beams 2, as well as immobilizing means 3, such as an extensible bar equipped with a vice, a hand or a clamp to fasten it to a structure 4, such as a bed structure.

The base 1 supports, via a pivoting axis A—A' having a horizontal reference position, a femoral section or beam 5, adapted to be brought in stable horizontal rest position above said base 1 or to be angularly oriented with respect to the latter. Said axis A—A' is materialized in any suitable manner known in the technique, as a function of the design of the base 1 and of that of the femoral beam 5, which latter is preferably constituted by two parallel longitudinal members 6 joined together by two cross-pieces 7. Beam 5 is operationally coupled to a drive member 8, whose role is to control, as a function of its feed, the pivoting movement of the beam with respect to the base, from the rest position shown in FIG. 3 to the maximum angulation position and vice-versa. In the illustrated example, and according to a preferred embodiment, the drive member 8 is constituted by an electric motor 9 mounted on the base 1 via a pivoting pin 10 parallel to axis A—A'. The output shaft of the electric motor 9 is constituted by a very long screw on which is screwed a nut 11, articulated by way of an axis 12, on a fork 13 upwardly projecting from the longitudinal members 6. Thus the screw of the motor 9 is placed between the longitudinal members 6, in the same way as a rod 14 parallel thereto. Rod 14 supports end-of-stroke inverters-contactors, adjustable in position and adapted to cooperate with the nut 11 to control the supply to the motor 9.

The distal end of the beam 5 comprises, laterally to longitudinal members 6, two slides 15, on either one of which can be adapted an articulated assembly 16 forming splint. Said assembly 16 comprises a femoral cradle 17 provided with two cheek pieces 18 equipped with pivot pins 19 enabling them to pivot with respect to a tibial cradle 20. As can be seen in FIGS. 1 and 2, with these means, said assembly 16 can be shifted laterally to either sides of the beam 5, so that the femoral cradle 17 extends in parallel to said beam. Said cheek pieces 18 are equipped with a bar 21 designed to cooperate with one of the slides 15 which are provided to this effect, with a member, not shown, for immobilizing the bar.

In known manner, the arms or slides 15 are adjustably mounted, via slides, on the longitudinal members 6. Said slides then enable adjusting of the distance between axes 19 and axis A—A', in relation to the patient's morphology.

The tibial cradle 20 and the femoral cradle 17 are constituted in kown manner by parallel longitudinal members joined together by straps or hammocks l6*a* the role of which is, respectively, to support the leg and the thigh of a lower limb with respect to which the base 1 and beam 5 are accordingly disposed laterally The femoral cradle 20 is provided at its distal end, with a footplate 22 for supporting the foot of a lower limb, and with a running member 23 able to rest and to roll over the supporting plane of the base 1. Such a member 23 is preferably constituted by a train 24 of wheels or runners.

Figure 3:
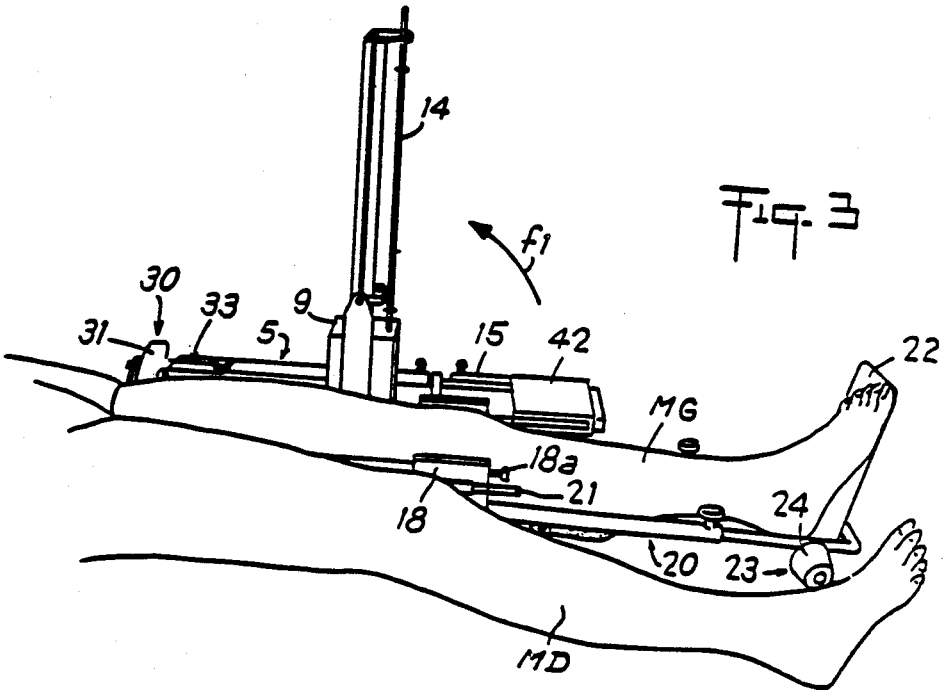
FIGS. 3 and 4 are lateral perspectives showing two particular embodiments of the object of the invention.

The special embodiment, consisting in placing the articulated assembly 16 laterally to the beam 5, permits the outward shifting of said beam and base 1 with respect to the limb to be reeducated, such as for example the left leg of a patient, as illustrated in FIGS. 2 and 3. It is then possible, by lowering the beam 5 to a maximum, to place the latter inside a superposed plane substantially parallel to base 1 and thus to obtain a maximum extension of the tibial cradle when the member 23 is resting on the support plane of the base 1.

In this position, illustrated in FIG. 3, the articulated assembly 16 is then capable of supporting the lower limb in a position where the hip is in maximum extension or nil flexion, namely a natural physiological position, parallel to the support plane, such as on top of a mattress.

The mobilization apparatus is designed in such a way that, in the aforesaid position, axis A—A', which is deliberately raised with respect to the base 1, coincides substantially with the coxofemoral articulation of the lower limb, the axes of articulation 19 correspond substantially to the axis of anteroposterior articulation of the knee and the ankle articulation is in alignment with the two aforesaid articulations. This result is achieved by raising axis A—A' with respect to the base and by raising the running member 23 at such a height that the tibial section 20 is placed in extension of the femoral section 17.

From that physiological position of maximum extension and nil flexion of the hip, supply of the electric motor 9 in the adequate direction causes the beam 5 to pivot in the direction of arrow $f_1$ (FIG. 3) on axis A—A'. Given the horizontal position of reference of said axis, such as indicated hereinabove, the pivoting movement in the direction of arrow $f_1$ is then performed according to a vertical sagittal plane, entailing via the beam, the corresponding displacement of the articulated assembly 16.

More particularly, the pivoting movement of the beam 5 in the direction of arrow $f_1$, carries the femoral cradle 17 in the corresponding direction, whereas the tibial cradle remains initially in resting contact on the supporting plane via the running members 23. Thus, as the beam 5 gradually pivots in the direction of arrow $f_1$, the articulated assembly 16 ensures passive mobilization of the coxofemoral articulation coinciding substantially with axis A—A' and of the knee joint by pivoting of the tibial cradle 20 on pivot pin 19 in the direction of arrow $f_2$.

Supply in reverse of the electric motor makes it possible to control the pivoting of the beam in the opposite direction to that of arrow $f_1$, and then to cause, by lowering the beam 5 or reducing its angular opening, the extension of the articulated assembly 16 back to its original position such as illustrated in FIG. 3.

Figure 4:
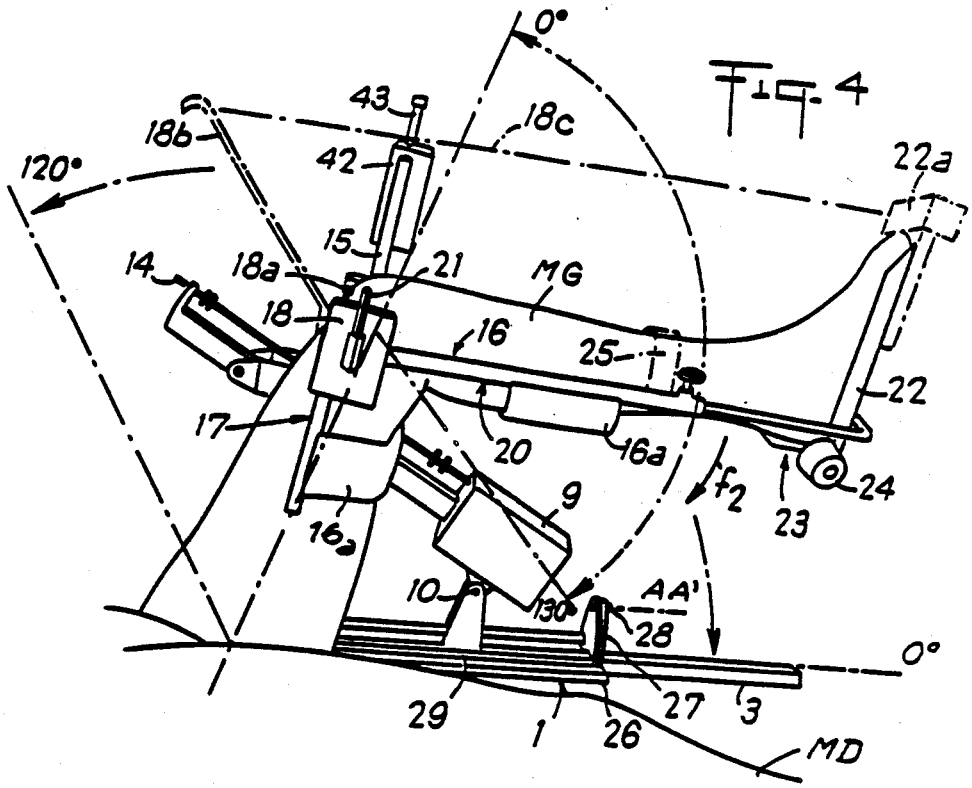

The amplitude of the angular displacement of the beam 5 in the direction of arrow $f_1$ may be controlled automatically by adjusting the inverters-contactors or, at will, by the patient. Generally speaking, this amplitude, illustrated in FIG. 4, is equal to 120°. FIG. 4 also shows that, depending on the adjustment of abutment l8*a* of at least one of the cheek-pieces 18, it is possible to limit the resulting flexion of the tibial section 20 to any value between 0° and 130°. Said adjustment may be selected as a function of a passive mobilization treatment or else as a function of the angular amplitude required to promote active mobilization, for a muscular reeducation. In this last case, it suffices to strap the leg on the cradle 20 with a strap 25. FIG. 4 shows in dash-and-dot lines that sole-plate 22 may be designed to support a movable or adjustable counterweight 22*a*, in order to obtain a reversed active mobilization.

There is also a possibility of adapting movable bars 18*b* on the cheeks 18, in order to fix one or more elastic cords 18*c*, which are otherwise secured to the sole plate 22; these permitting an assisted reeducation in extension.

The structure according to the invention, which consists in adapting, laterally to a pivoting beam, an articulated assembly constituted of a femoral cradle and a tibial cradle, with the possibilility of immobilizing the femoral cradle in parallel to said beam, makes it possible to shift laterally and outwardly of the lower limit to be treated, the support base, the motor 9 and the beam 5, and thus to place, if the need arises, the articulated assembly 16 in a maximum extension position parallely to the support plane, such as the top of a mattress. This particular construction thus gives a possibility of obtaining a passive mobilization of the leg in flexion-extension from a maximum extension position or from a position of nil flexion of the hip.

It is further possible with this particular construction to use the same apparatus, indifferently, for a right or a left limb, since it is simply a question of adapting the articulated assembly 16 on either one of the lateral slides 15, depending on whether assembly 16 should be shifted to the left or to the right, and of laterally shifting the beam 5 and the base 1 in the opposite direction.

The special construction according to the invention further procures, to the mobilization apparatus, a new and additional function of mobilization in concomitant abduction combined with the mobilization in flexion of the lower limb, and vice-versa, namely a function of concomitant mobilization in adduction combined with a mobilization in extension.

Figure 5:
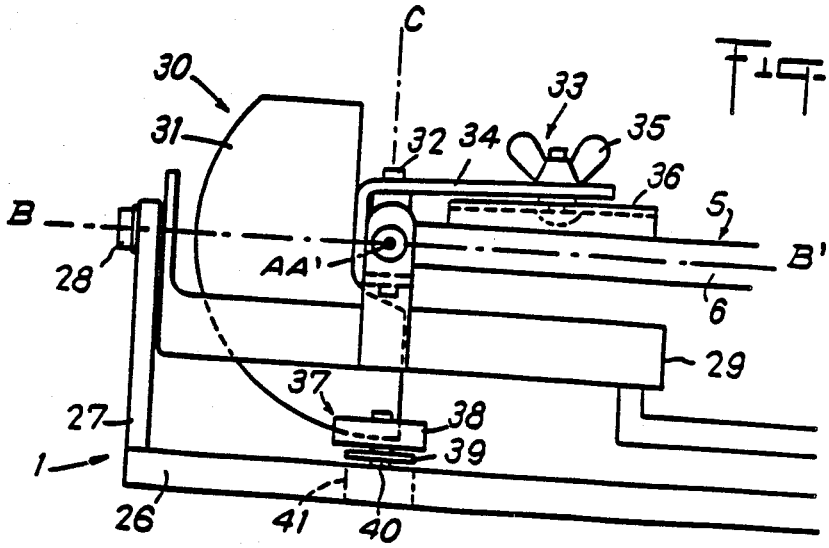
FIG. 5 is a partial side view showing, on a larger scale, a second constructional embodiment of the invention.
Figure 6:
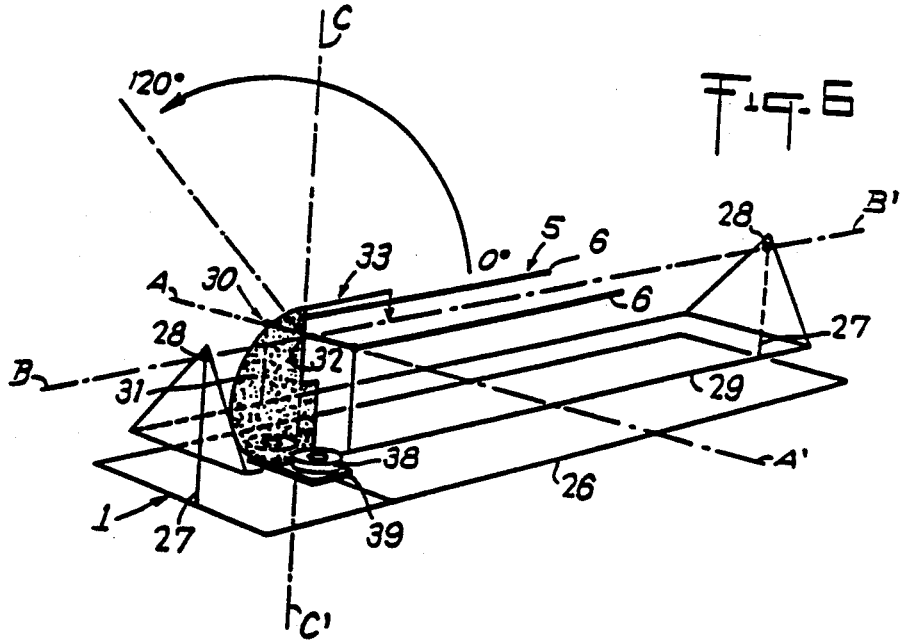
FIG. 6 is a diagrammatical perspective showing a constructional feature of the embodiment shown in FIG. 5.

To this end, and as illustrated in FIGS. 1 ,2 and 5, the base 1 is constituted by a rigid framework 26, comprising two supports 27 or the like. Said supports 27 project vertically and contain two pivot pins 28 in alignment, said pivot pins defining together a horizontal pivoting axis B—B′ parallel to the framework 26 and extending in the direction of the median longitudinal plane of the base 1. Said pivot pins 28 support a pivoting cradle 29 containing axis A—A′ and pivot pin 10. FIGS. 5 and 6 illustrate the fact that the pivoting cradle 29 is produced so that axis A—A′ cuts through pivoting axis B—B′ by being perpendicular thereto.

The pivoting cradle 29 further carries a device 30 for urging the beam 5 in concomitant abduction and combined with the pivoting in flexion and in concomitant adduction combined with the pivoting in extension. Said device 30 comprises a flat rudder 31, mounted on the cradle 29 by way of a pivot pin 32 defining a pivoting axis C—C′, which extends vertically in the horizontal position of reference of axis A—A′. Axis C—C′ goes through the fictitious point of intersection I of axes A—A′ and B—B′ and follows a direction perpendicular to axis B—B′.

Said flat rudder 31 is joined to cradle 29 by means of an adjustable device 33 comprising, for example, a small bar 34 which can be locked in position by a nut 35 against graduations carried by a sector 36 fixed on cradle 29. Said graduated sector 36 may be of the type with a curved opening to allow through the screw cooperating with the nut 35. In a neutral position of reference, the device 33 is adjusted so that the flat rudder 31, situated opposite the distal end of the beam 5 with respect to axis A—A′, coincides, when the latter occupies its horizontal position of reference, with the longitudinal median plane of the base 1 cutting through axis B—B′.

The shape of rudder 31 is substantially semi-circular and cooperates permanently with a guide 37 provided on the framework 26. Said guide 37 is preferably constituted by two runners 38 pivoting on vertical pins carried by a disc 39 mounted via a vertical pivot pin 40 on a cross-beam 41 forming part of the framework 26. Said pivot pin 40 is placed in such a way as to be in alignment with axis C—C′, when axis A—A′ occupies the horizontal position of reference. In said position, said pivot pin 40 permits the control to the right or to the left of the inclination of the rudder 31.

In the neutral adjustment position of the rudder 31, as illustrated in FIGS. 2, 5 and 6, supply of electric motor 9 causes, as indicated hereinabove, the pivoting movement of the beam 5 about axis A—A′. Considering that the flat rudder 31 is situated inside the longitudinal median plane of the base 1 which cuts through axis A—A′, said rudder then is moved by sliding between runners 38, without the pivoting movement of the beam 5 which follows the sagittal or zenithal plane and causes a flexion-extension of the lower limb, being altered as a result.

Figure 7:
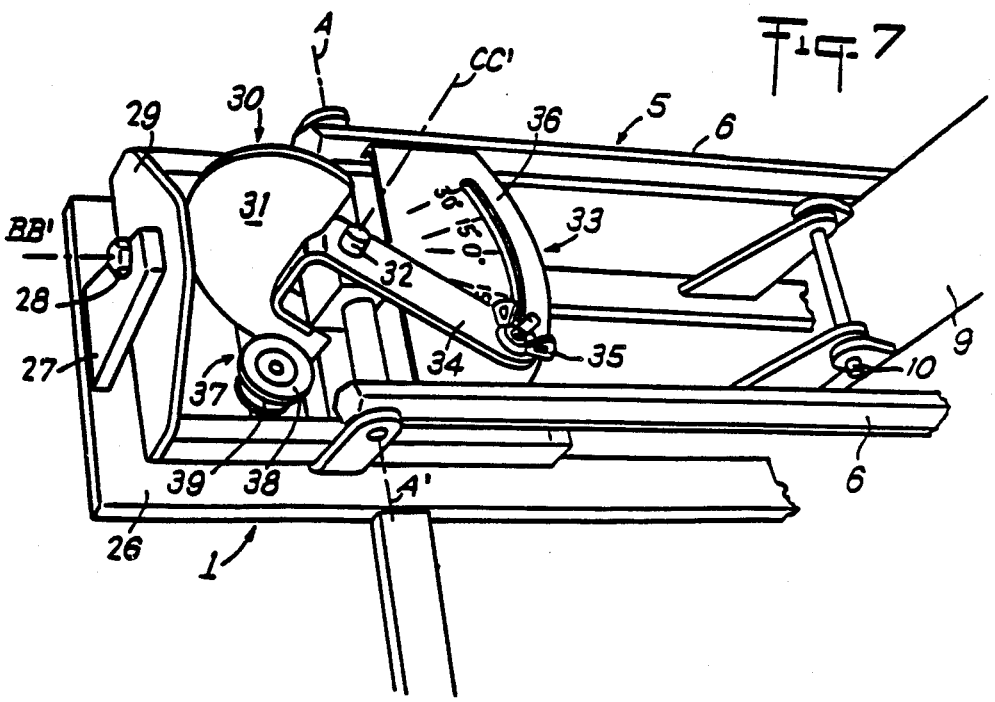
FIGS. 7 and 8 are partial perspectives showing two special working positions of the embodiment according to FIGS. 5 and 6.
Figure 8:
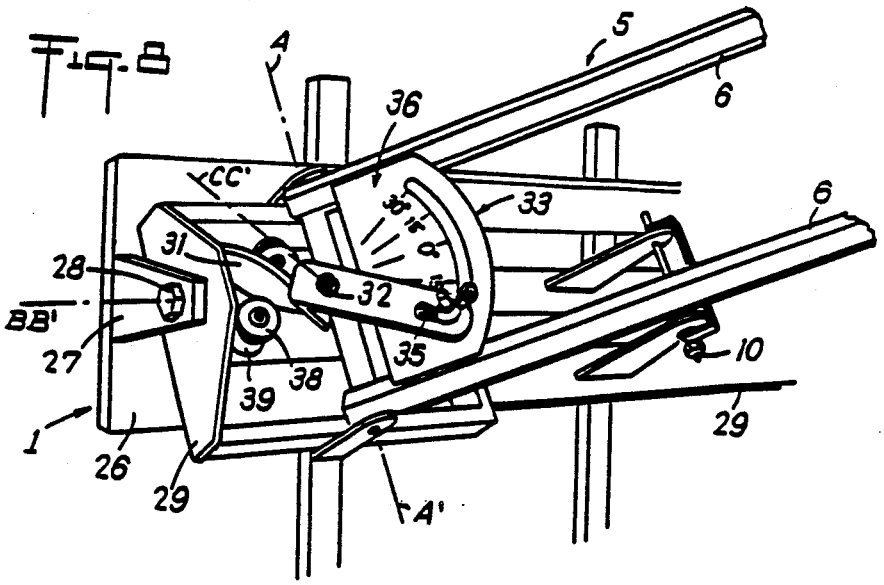
Figure 9:
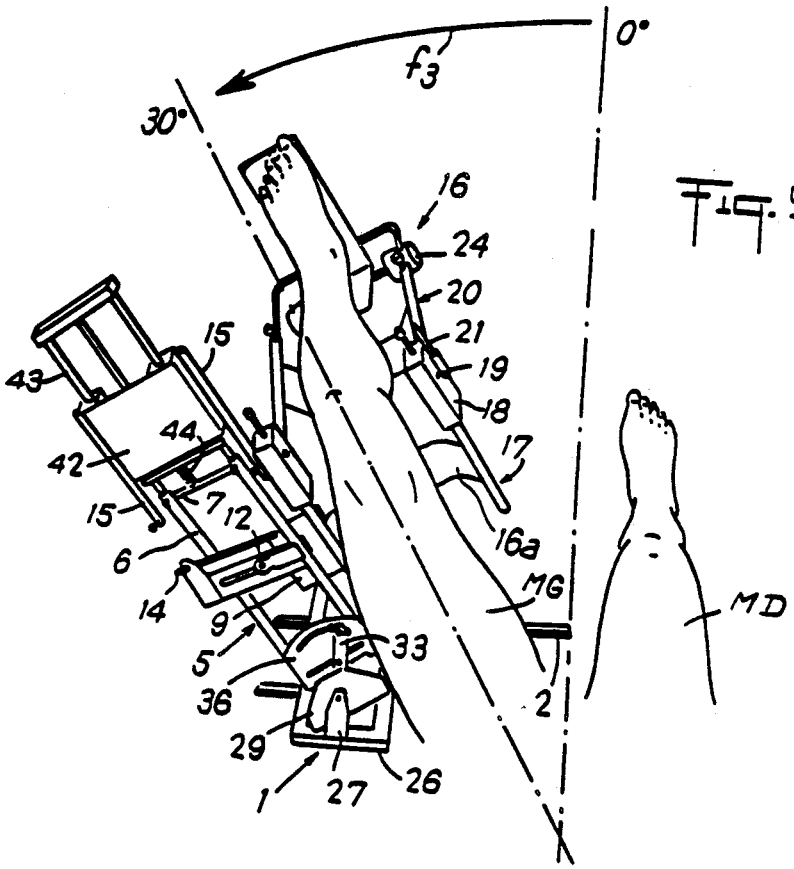
FIG. 9 is a plan view, similar to FIG. 2, illustrating the special function of the mobilization apparatus equipped with the device according to FIGS. 5 and 6.

If, as illustrated in FIG. 7, the rudder 31 is adjusted by member 33 so as to present a deflection towards the left, the pivoting of the beam 5 according to $f_1$ causes, due to the rudder 31 moving through the runners 38, a reaction component which urges the cradle 26 into a progressive pivoting movement about axis B—B′. The beam 5 then urges the splint 16 into an abduction movement leftward according to arrow $f_3$ which is concomitant and combined with the flexion movement (FIGS. 8 and 9). Said abduction movement reaches its maximum amplitude for a flexion displacement of 90° of the beam 5.

When the motor is supplied in reverse, the beam 8 is urged to pivot in the direction opposite that of arrow $f_1$, this resulting in causing a mobilization in extension of the lower limb with, simultaneously, a displacement in combined concomitant adduction until the lower limb returns to the position parallel to the antero-posterior or sagittal plane of the body.

Figure 10:
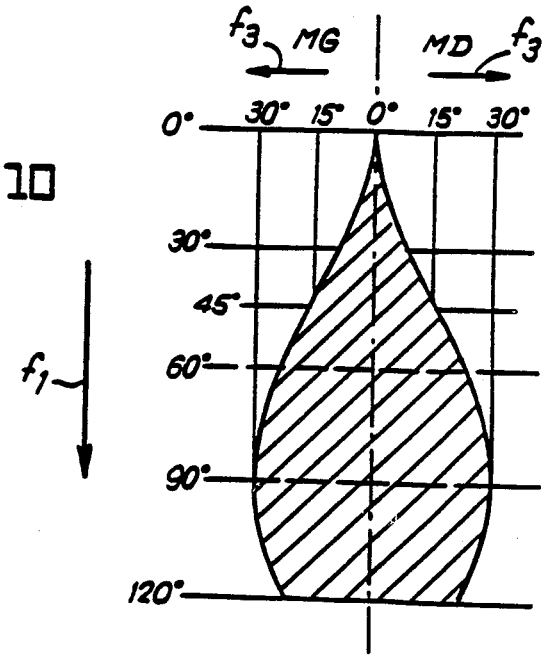
FIG. 10 is a diagram illustrating one of the working possibilities of the invention

FIG. 10 shows a diagram illustrating the amplitude of maximum abduction of the left and right legs when the rudder 31 is adjusted to maximum inclination either to the left or to the right. In regard to the physiological conditions of mobilization, the amplitude of inclination of the rudder to the right or to the left is limited to 30°.

Figure 11B:
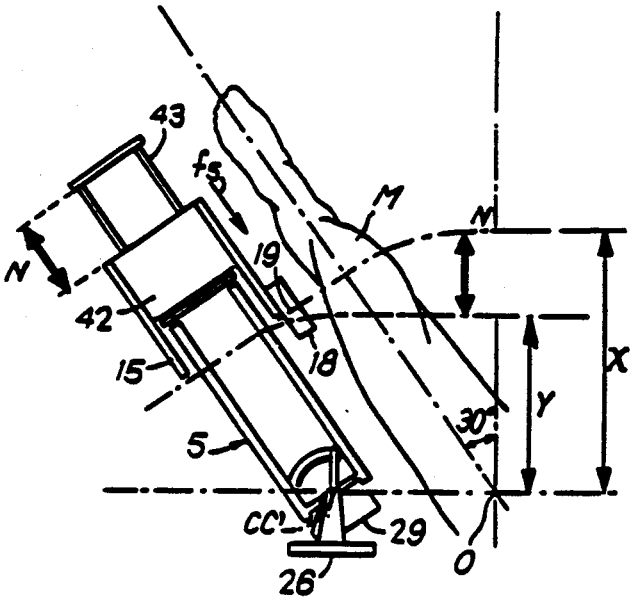
FIGS. 11*a* and 11*b* are two diagrammatical plan views illustrating a special embodiment of the invention.
Figure 11A:
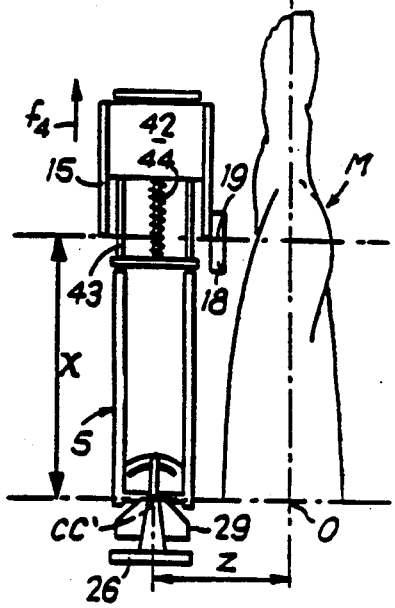

FIGS. 2 and 11*a* prove that the mobilization apparatus according to the invention is built so as to comprise a beam 5 which is situated sideways and externally to a limb M to be mobilized. In this position, axis A—A′ coincides with the coxofemoral articulation of which the theoretical pivoting point is diagrammatically represented by the letter 0. Understandably, if in the position illustrated in FIG. 11*a*, an abduction movement is imposed to the beam 5 and to the limb M, such a movement is performed, for the beam 5, on the center C—C′ and for the limb M on the center 0.

Given the lateral offset Z between the rotation center, what would happen then would be a shift of value N between the knee joint and the pivot pins 19, N being equal to the difference between the real distance X existing between pivot pins 19 and axis C—C′ in the position of reference such as shown in FIG. 11*a*, and the contemplated length Y which, in view of the lateral shift between axis C—C′ and the center 0, corresponds to the distance which must separate axis C—C′ from pivot pin 19, when beam 5 is in maximum abduction.

In order to prevent such a distortion and to keep a substantially constant alignment between the knee joint and the pivot pins 19, in a position of maximum abduction such as illustrated in FIG. 11*b*, the invention proposes to have the arms 15 supported by a slide block 42, mounted on one or more slides 43 extending from the distal end of the beam 5. Said slide-block 42 is operationally coupled to an elastic member 44 urging it into a maximum displacement on the slides 43 in the direction of arrow $f_4$. Thus, as an abduction movement progresses between FIGS. 11*a* and 11*b*, the slide block 42 is urged by the assembly 16 to move in the direction of arrow $f_5$ over the slides 43, causing the stressing of the spring 44. Such progressive displacement allows a virtually permanent coincidence to be kept between the pivot pins 19 and the axis of the knee. The slides 43 are designed so as to authorize a freedom of rectilinear displacement of the slideblock 42 over a length at least equal to value N.

When the drive member 9 is supplied for controlling the beam 5 in an extension movement, the strain imposed on the articulated assembly 16 decreases progressively so that the pressure stored by the spring under stress is restored and progressively urges the slide-block 42 over the slides 43, back to the original position.

The invention is in no way limited to the description given hereinabove and on the contrary covers any modifications that can be brought thereto without departing from its scope.

What is claimed is:

1. Apparatus for the mobilization of a lower limb, of the type comprising a base, an articulated assembly formed by a femoral section and tibial section mounted on the base and a drive member for pivoting said articulated assembly with respect to the base, wherein said apparatus comprises: a beam mounted for pivoting on the base via an axis of horizontal reference position, a drive member controlling the pivoting movement of the beam between a stable horizontal rest position and a maximum angular opening position, and vice versa, an articulated assembly placed sideways with respect to either one of the sides of the drive member, and means for resting and rolling the distal end of the tibial section of the articulated assembly over a base supporting plane, wherein said base comprises: a support framework containing two raised, horizontal and co-axial pivot pins defining a pivoting axis, a pivoting cradle mounted on said pivot pins and bearing the pivoting axis of the beam, which axis is perpendicular to the pivoting axis through which its cuts, and means of urging the beam in concomitant abduction combined with the pivoting in flexion of the beam, and in concomitant adduction combined with the pivoting in extension of said beam.

2. Mobilization apparatus as claimed in claim 1 wherein the beam is mounted on the base by way of a pivoting axis which is raised in order to coincide substantially, when in the horizontal reference position, with the coxofemoral articulation of the lower limb of a patient lying on his back on the support plane in parallel and laterally to the apparatus.

3. Mobilization apparatus as claimed in claim 2, wherein said beam supports the articulated assembly be means of a system for adjusting the distance between its pivoting axis and the axis of articulation of the sections constituting said articulated assembly.

4. Mobilization apparatus as claimed in claim 1, wherein the drive motor member includes a interposed between the cradle of the base and the beam while being mounted on the two elements about two pivotal axis.

5. Apparatus for the mobilization of a lower limb, of the type comprising a base, an articulated assembly formed by a femoral section and a tibial section mounted on the base and a drive member for pivoting said articulated assembly with respect to the base, wherein said apparatus comprises: a beam mounted for pivoting on the base via an axis of horizontal reference position, a drive member controlling the pivoting movement of the beam between a stable horizontal rest position and a maximum angular opening position, and vice versa, an articulated assembly placed sideways with respect to either one of the sides of the beam, and means for resting and rolling the distal end of the tibial section of the articulated assembly over a base supporting plane;

wherein said base comprises: a support framework containing two raised, horizontal and coaxial pivot pins defining a pivoting axis, a pivoting cradle mounted on said pivot pins and bearing the pivoting axis of the beam, which axis is perpendicular to the pivoting axis through which is cuts, and means of urging the beam in concomitant abduction combined with the pivoting in flexion of the beam, and in concomitant adduction combined with the pivoting in extension of said beam; and wherein the device urging the beam in abduction comprises: a flat rudder mounted on the pivoting cradle by way of a pivot pin (C—C') which is perpendicular to the common plane of pivoting axis (A—A') and pivoting axis (B—B') and passes through the fictitious point of intersection thereof, said rudder being mounted such that its plane traverses the pivot axis, means for adjusting the angular position of the rudder with respect to the pivoting axis of the beam, and a guide cooperating with the rudder and borne by a disc mounted on the framework.

6. An apparatus for exercising a leg, comprising:

a base;

support means for supporting the leg, said support means including a cradle for supporting the portion of the leg above the knee and a cradle for supporting the portion of the leg below the knee, said cradles being aligned to prevent twisting of the knee during operation;

means for coupling said support means to said base to allow said support means to pivot such that the leg pivots at the hip to cause a flexion/extension of the leg through bending at the knee and to allow said support means to rotate such that the leg rotates at the hip about an axis parallel to the longitudinal axis of the body;

means for pivoting said support means through an angle such that the leg pivots at the hip to cause a flexion/extension of the leg through bending at the knee; and means for rotating said support means through an angle such that the leg rotates at the hip about an axis parallel to the longitudinal axis of the body, said rotating means including a linkage coupled to said support means and to said base so that as said support means pivots, said linkage causes said support means to rotate in a synchronized relationship with the pivoting motion.

7. The apparatus of claim 6 wherein the rotation angle of the support means is variable.

8. The apparatus of claim 6 wherein the pivoting angle of the support means is variable.

9. The apparatus for claim 6 wherein the amount of anteroposterior articulation of the knee is variable.

10. The apparatus of claim 6 wherein the apparatus is adapted for operation of the left leg or the right leg.

11. Mobilization apparatus as claimed in claim 5, wherein said guide is constituted by two runners carried by the disc which is mounted on the framework by way of a pivot pin of vertical axis, said axis cutting through the intersecting point of pivoting axes (B—B') and (A—A') in the horizontal reference position of said pivot pin.

12. Apparatus for the mobilization of a lower limb, of the type comprising a base, an articulated assembly formed by a femoral section and a tibial section mounted on the base and a drive member for pivoting said articulated assembly with respect to the base, wherein said apparatus comprises: a beam mounted for pivoting on the base via an axis of horizontal reference position, a drive member controlling the pivoting movement of the beam between a stable horizontal rest position and a maximum angular opening position, and vice versa, an articulated assembly placed sideways with respect to either one of the sides of the beam, and means for resting and rolling the distal end of the tibial section of the articulated assembly over a base supporting plane;

wherein said base comprises: a support framework containing two raised, horizontal and coaxial pivot pins defining a pivoting axis, a pivoting cradle mounted on said pivot pins and bearing the pivoting axis of the beam, which axis is perpendicular to the pivoting axis through which it cuts, and means of urging the beam in concomitant abduction combined with the pivoting in flexion of the beam, and in concomitant adduction combined with the pivoting in extension of said beam; and wherein the base supports a beam of which the free end portion forms a slide supporting and guiding a slide block which is urged in distal displacement by a spring, and forming two lateral slide means for assembling the articulated assembly.

13. Mobilization apparatus as claimed in claim 1 wherein the means for resting and rolling the distal end of the tibial section maintains said tibial section in line with the femoral section when the beam is placed in a stable rest horizontal position.

14. An apparatus for exercising a leg, comprising:

a base;

support means for supporting the leg, said support means including a cradle for supporting the portion of the leg above the knee and a cradle for supporting the portion of the leg below the knee, said cradles being aligned to prevent twisting of the knee during operation;

means for coupling said support means to said base to allow said support means to pivot such that the leg pivots at the hip to cause a flexion/extension of the leg through bending at the knee and to allow said support means to pivot such that the leg pivots at the hip to cause an abduction/adduction of the hip;

means for pivoting said support means through an angle such that the leg pivots at the hip to cause a flexion/extension of the leg through bending at the knee; and means for pivoting said support means through an angle such that the leg rotates at the hip to cause an abduction/adduction of the hip, said abduction/adduction pivoting means including a linkage coupled to said support means and to said base so that as said support means pivots causing flexion/extension, said linkage causes said support means to pivot causing abduction/adduction in a synchronized relationship with the flexion/extension pivoting motion.

15. The apparatus of claim 14, further comprising:

means for moving the support means to cause an amount of anteroposterior articulation of the knee, wherein the knee articulation occurs concurrently with the hip flexion/extension.

16. Apparatus for the mobilization of a lower limb, of the type comprising a base, an articulated assembly formed by a femoral section and a tibial section mounted on the base and a drive member for pivoting said articulated assembly with respect to the base, wherein said apparatus comprises: a beam mounted for pivoting on the base via an axis of horizontal reference position, a drive member controlling the pivoting movement of the beam between a stable horizontal rest position and a maximum angular opening position, and vice versa, an articulated assembly placed sideways with respect to either one of the sides of the drive member, and means for resting and rolling the distal end of the tibial section of the articulated assembly over a base support plane, wherein the beam is mounted on the base by way of a pivoting axis which is raised in order to coincide substantially, when in the horizontal reference position, with the coxofemoral articulation of the lower limb of a patient lying on his back on the support plane in parallel and laterally to the apparatus.

* * * * *

UNITED STATES PATENT AND TRADEMARK OFFICE

CERTIFICATE OF CORRECTION

PATENT NO. : 4,905,677

DATED : March 6, 1990

INVENTOR(S) : Jean-Claude Pecheux

It is certified that error appears in the above-identified patent and that said Letters Patent is hereby corrected as shown below:

At column 1, lines 62-63, after "adduction movement" insert --.--.

At column 2, line 42, after "invention" insert --.--.

At column 3, line 33, change "kown" to --known--.

At column 3, line 37, after "laterally" insert --.--.

At column 6, lines 38-39, change "center" to --centers--.

At column 6, line 65, change "slideblock" to --slide-block--.

At column 7, line 11, before "tibial" insert --a--.

At column 7, line 34, after "claim 1" insert --,--.

At column 7, line 42, change "be" to --by--.

At column 7, line 47, change "motor member includes a" to --member includes a motor--.

At column 9, line 40, change "at" to --of--.

At column 10, line 34, change "support" to --supporting--.

Signed and Sealed this

Seventeenth Day of December, 1991

*Attest:*

HARRY F. MANBECK, JR.

*Attesting Officer*

*Commissioner of Patents and Trademarks*